US005970755A

United States Patent [19]

Appelbaum

[11] Patent Number: 5,970,755

[45] Date of Patent: Oct. 26, 1999

[54] COMBINATION LOCK WITH RESET BUTTON EXTENSION

[76] Inventor: Paul Appelbaum, 24 5th Pl., Long Beach, Calif. 90802

[21] Appl. No.: 09/179,379

[22] Filed: Oct. 26, 1998

[51] Int. Cl.[6] ..... E05B 37/02

[52] U.S. Cl. ..... 70/28; 70/311; 70/312

[58] Field of Search ..... 70/28, 312, 22, 70/24, 3, 27, 29, 311, 321, 322

[56] References Cited

U.S. PATENT DOCUMENTS

| | | | |
|---|---|---|---|
| 89,826 | 5/1869 | Arnold | 70/28 |
| 1,205,781 | 11/1916 | Piróg | 70/28 |
| 1,354,773 | 10/1920 | Mazuryk | 70/28 |
| 4,610,152 | 9/1986 | Düringer | 70/30 |
| 4,860,561 | 8/1989 | Hwang | 70/28 |
| 5,156,028 | 10/1992 | Jiang | 70/30 |
| 5,193,367 | 3/1993 | Ling | 70/28 |
| 5,685,179 | 11/1997 | Yang | 70/53 X |
| 5,765,409 | 6/1998 | Yang | 70/28 |
| 5,782,113 | 7/1998 | Chen | 70/28 |
| 5,791,169 | 8/1998 | Kuo | 70/28 X |

FOREIGN PATENT DOCUMENTS

| | | | |
|---|---|---|---|
| 137289 | 4/1934 | Germany | 70/312 |
| 3410047 | 10/1985 | Germany | 70/312 |

*Primary Examiner*—Lloyd A. Gall
*Attorney, Agent, or Firm*—Charles C. Corbin

[57] ABSTRACT

Disclosed is a portable combination lock having a reset button extension member, the lock having an elongated outer case that encloses lock mechanism including several spaced-apart numbered dials rotatably mounted on a longitudinally extending shaft assembly. A latch is mounted to the front end of the case and one end of the shaft assembly is adapted to shift axially to lock and unlock the latch. The other end of the shaft assembly is depressible in an axial direction against spring force when the combination is set to unlock the mechanism, to allow the lock combination to be reset as desired. The extension member has a first end mounted to the rear end of the case, and it extends longitudinally from the case to its distal end. The lock can be held by its case and the distal end of the extension member pressed against an immovable surface to cause a forward portion of the extension member to engage and operate the depressible end of the shaft assembly.

4 Claims, 1 Drawing Sheet

COMBINATION LOCK WITH RESET BUTTON EXTENSION

BACKGROUND OF THE INVENTION

1. Field of the Invention

The present invention relates to portable resettable combination locks.

2. Description of the Prior Art

The prior art is replete with a variety of portable resettable combination-type locks. Although these prior locks each are well-suited for their particular intended purposes, they nevertheless have certain limitations. One drawback for example, of prior portable combination lock designs of the type that can be reset by depressing a reset button, is the necessity of using two hands to carry out the resetting operation.

SUMMARY OF THE INVENTION

In view of the fore-stated limitations, it is an object of the present invention to provide a portable combination-type lock with enhanced capabilities, including improved resetting convenience.

A more particular object is to provide a portable resettable combination lock that does not require the use of two hands for resetting.

These and other objects and advantages are provided by the present invention of a portable resettable combination lock having an elongated outer case enclosing a lock mechanism that includes a plurality of spaced-apart peripherally-numbered dials rotatably mounted on a longitudinally extending shaft assembly, wherein a latch mean s is mounted to the first end of the case and one end of the shaft assembly is adapted to shift axially to engage and lock and unlock the latch means, and the other end of said shaft assembly being axially depressible against spring force, to allow the lock mechanism to be reset.

The invention features an extension member which has a first end mounted to the rear end of the case, and extends longitudinally to its distal end. The extension portion is adapted to be shifted axially towards the case to cause a forward part of the extension member to engage and operate the depressible rear end of said shaft assembly.

In a preferred embodiment the extension member provides an appreciable surface area for a graphical display, and it can have various ornamental shapes. In one preferred embodiment a forward end portion of the extension member is slidably mounted in the case rear end for limited axial movement, and is adapted to engage said depressible rear end of the shaft assembly.

DETAILED DESCRIPTION OF THE INVENTION

Figure 1:
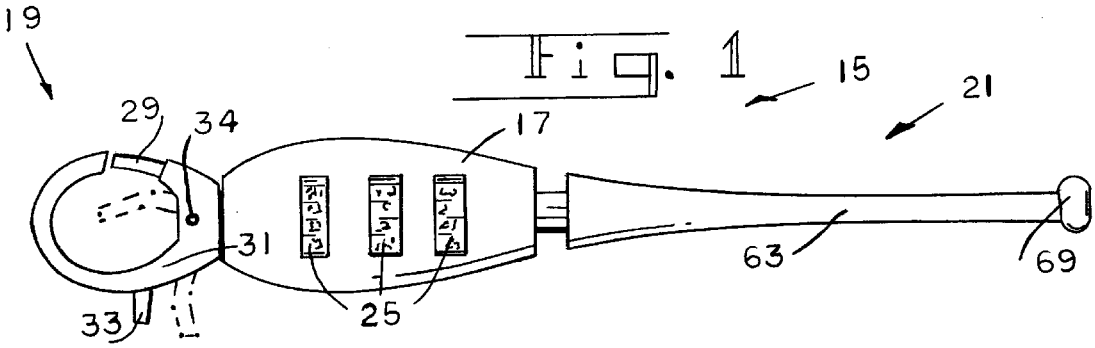
FIG. 1 is a side elevational view of a preferred embodiment of a resettable combination lock according the present invention.

Referring now to the drawings, FIG. 1 shows that the main components of a resettable combination lock 15 according to the present invention, comprise an elongate metal case 17, a lockable latch 19 mounted to one end of the case 17, and a reset (extension) member 21.

Case 17 encloses a resettable combination lock mechanism that includes several rotatable numbered dials 25. Note that the latch 19 features a clasp 29 that is pivotally mounted to rotate about pin 34 within a portion of a hook 31, the clasp having a finger-operated lever 33. A spring (not shown) urges the clasp 29 and leave 33 to rotate about pin 34 towards the position shown in FIG. 1. When the clasp 29 is unlocked, in a manner to be described hereinafter, the clasp is rotatable inwardly to the "open" position illustrated by broken lines. The locking mechanism includes a shaft assembly 37, partially shown in FIG. 2, and it has an end 39 that will abut a surface 43 of the clasp 29 as to hold the clasp 29 locked against rotation when the locking mechanism is in locked condition. There is a certain combination of numbers on the dials 25 that will unlock the lock mechanism, and in that condition the shaft end 39 will be freed to move inwardly thereby allowing the clasp 29 to be rotated. At the opposite end of the shaft assembly 37 there is an end 49 that is free to be depressed inwardly when the combination dials are set to open position. Then, by holding the end 49 in a depressed position, the combination of the locking mechanism can be changed by merely rotating the dials to the desired numbers, and then releasing the tip/end 49 which will return by the force of a spring (not shown) to the position shown in FIG. 2.

Figure 2:
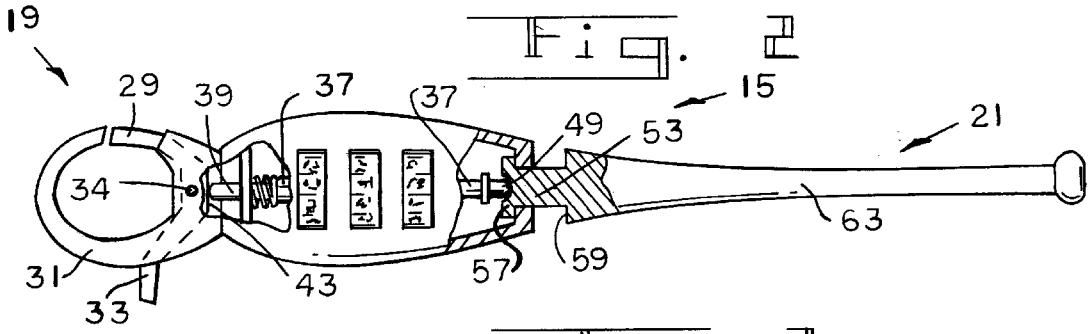
FIG. 2 is a partially sectional, side elevational view of the embodiment shown in FIG. 1, with parts broken away for the sake of clarity.

FIG. 2 shows how a forward portion 53 of the extension member 21 is slidably mounted within an open end of the case 17, for limited axial movement as determined by the shoulders 57 and 59. The tip/end 49 engages the forward portion 53 and the aforementioned spring will thereby urge the extension member 21 into the position shown in FIGS. 1 and 2. Note that the exterior surface of the extension member 21 provides a useful surface for holding text and graphic displays. When it is desired to change the code for the combination lock mechanism, the lock 15 is handled as follows to conveniently achieve this function. With the lock mechanism set to open, the user can use one hand to grasp the lock 15 by the housing 17. Then the lock end 69 can be pushed against an immobile surface to cause the forward portion 53 of the extension member 21 to depress shaft end 37. The dials 25 can then be set to a new code, and then pressure is released on the end 69 and the resetting process is completed.

Figure 3:
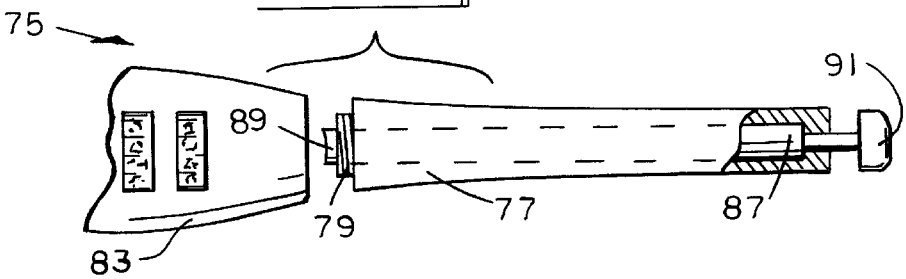
FIG. 3 is a partial, side elevational exploded view of a variant of a resettable combination lock according to the present invention.
Figure 4:
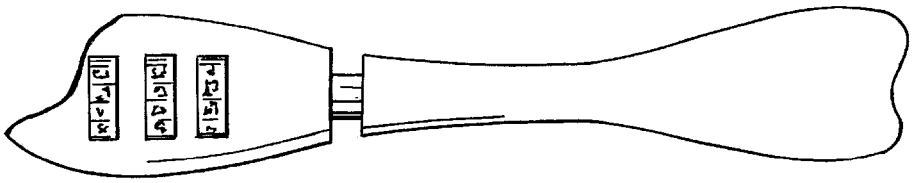
FIG. 4 is partial side elevational view of a variant of the invention with a decorative extended portion.

FIG. 3 shows a variant 75, which is similar to the above-described lock 15 except here the extension member 77 has a threaded front end 79 that is connected to complementary threads in the end of the housing 83. A longitudinal bore in member 77 receives a pin 87 having a front end 89 adapted for engaging the depressible end of the lock mechanism shaft assembly (not shown). A knob 91 is secured to the rear end of pin 87, and it is depressible to cause movement of the pin 87 when the lock mechanism is reset.

It will be apparent from the foregoing description that many changes can be made in the preferred embodiments without departing from the full scope and breadth of the invention which is defined in the following claims.

What is claimed is:

1. A portable resettable combination lock, including:

a. an elongate outer case having a front end and a rear end;

b. lock mechanism enclosed by said case, including a longitudinally extending shaft assembly and a plurality of numbered dials for setting a combination code for unlocking said lock mechanism and rotatably mounted to said shaft assembly and said shaft assembly having a front end and a rear end;

c. latch means including a pivotally mounted clasp, mounted to the front end of said case and having a locked condition in which said clasp is held against rotation and an unlocked condition in which said clasp is free to rotate, and wherein said shaft assembly front end is forwardly shiftable to engage said clasp to hold said clasp against rotation to secure said latch means in its locked condition, and rearwardly shiftable to secure it in said unlocked condition; and d. an elongate extension member having a forward portion mounted to the rear end of said case, an intermediate portion extending substantially beyond said case rear end and having a major surface adapted for holding text and graphic displays and a distal end, and said member forward portion includes axially shiftable means for engaging and forwardly moving said shaft assembly rear end when said mechanism is set to said combination code for unlocking said mechanism.

2. A lock as defined in claim 1 wherein said member distal end is adapted for stationarily engaging an immobile surface to cause longitudinal movement of said axially shiftable means.

3. A lock as defined in claim 1 wherein said axially shiftable means includes a forward end that is slidably mounted for longitudinal movement in the rear end of said case.

4. A lock as defined in claim 1 wherein said axially shiftable means including an elongate pin mounted within said member for longitudinal movement, and said pin has a front end for engaging said shaft assembly rear end, and a depressible rear end that extends beyond the distal end of said member.

* * * * *